US005562018A

United States Patent [19]

Foster

[11] Patent Number: 5,562,018

[45] Date of Patent: Oct. 8, 1996

[54] HYDRAULIC VALVE

[76] Inventor: Raymond K. Foster, P.O. Box 1, Madras, Oreg. 97741

[21] Appl. No.: 561,378

[22] Filed: Nov. 21, 1995

[51] Int. Cl.[6] ..... F15B 15/22; F01B 15/04

[52] U.S. Cl. ..... 91/406; 91/418; 92/118

[58] Field of Search ..... 91/404, 406, 418, 91/392; 92/8 RB, 143, 119.1, 117 A; 60/589; 251/339

[56] References Cited

U.S. PATENT DOCUMENTS

| | | | |
|---|---|---|---|
| 3,056,165 | 10/1962 | Berrill et al. | 91/392 X |
| 4,472,942 | 9/1984 | Nomura et al. | 60/589 X |
| 4,709,805 | 12/1987 | Foster | 198/750 |
| 4,712,467 | 12/1987 | Foster | 91/176 |
| 4,788,821 | 12/1988 | Mienko et al. | 92/118 X |
| 4,852,351 | 8/1989 | Price | 60/589 X |
| 5,050,383 | 9/1991 | Nakaharai | 60/589 |
| 5,193,661 | 3/1993 | Foster | 198/750 |
| 5,273,405 | 12/1993 | Chalmers et al. | 92/85 BX |
| 5,315,916 | 5/1994 | Foster | 91/178 |
| 5,325,763 | 7/1994 | Foster | 91/422 |

FOREIGN PATENT DOCUMENTS

| | | | |
|---|---|---|---|
| 2075148 | 11/1981 | United Kingdom | 92/85 B |

*Primary Examiner*—Hoang Nguyen
*Attorney, Agent, or Firm*—David P. Campbell

[57] ABSTRACT

A check valve (10) for a hydraulic actuator (14), wherein the check valve (10) includes a valve seat (72) and a displaceable valve component (62) for controlling the flow of hydraulic oil through valve seat (72). Check valve (10) also includes a cylindrical body portion (50) and a cap (54). A slot (70) is formed in the sidewall of the cylinder (22) of the hydraulic actuator. A valve stem (66) of valve component (62) extends through slot (70) into the working chambers of cylinder (22) and into the path of movement of piston (16). Springs (80, 94) bias valve component (62) into its seated position. Engagement of piston (16) with the lower end (90) of valve stem (66) pivots valve component (62) and unseats the plug member of the valve to allow fluid communication between the working chambers of cylinder (22) and passageway (56).

21 Claims, 5 Drawing Sheets

HYDRAULIC VALVE

TECHNICAL FIELD

This invention pertains to hydraulic valves and, more particularly, to a check valve for a hydraulic actuator.

BACKGROUND OF THE INVENTION

It is common for a hydraulic actuator such as a linear hydraulic motor to include some type of flow control valve, such as a check valve, at either end of the cylinder component of the hydraulic motor. The flow control valve provides a signal to a switching or directional control valve. The check valve includes a movable valve component that is displaced when the piston component of the hydraulic motor engages the valve component at the end of the piston stroke. A typical situation is where the piston component engages the displaceable valve component of the check valve, causing the valve component to unseat and directing hydraulic oil to a directional control valve. The directional control valve reverses the flow of hydraulic oil to the hydraulic motor, causing the piston component to reverse direction.

It is well known in the art to position a check valve in a cylinder end wall of a linear hydraulic motor so that the piston component longitudinally displaces the valve component in the direction of piston travel. U.S. Pat. No. 4,709,805, entitled "Drive/Frame Assembly for Reciprocating Floor Conveyor," discloses a hydraulic motor having a check valve installed in an end wall of a cylinder component of the hydraulic actuator.

U.S. Pat. No. 4,712,467 discloses a hydraulic motor having a check valve positioned within a piston rod of the motor. U.S. Pat. No. 5,325,763, entitled, "Internal Check Valve," discloses an actuator having a similar design with a check valve within the piston rod. The foregoing patents utilize the same concept of having a check valve opened upon engagement of the piston with a cylinder end wall.

U.S. Pat. No. 5,315,916, entitled, "System of Linear Hydraulic Motors," discloses an actuator with an externally-actuated check valve.

In some applications, it may not be practical to design a check valve, or other type of valve, into the end wall of a cylinder component. For example, the cylinder component end wall may form a ball for a ball and socket support, which universally mounts the cylinder component to another structure. In such an application, it may be necessary to reposition the valve out of the ball end of the cylinder component, yet where the valve can still function to control hydraulic oil flow upon engagement of the piston component with the cylinder end wall. The present invention is directed to just such an application.

DISCLOSURE OF THE INVENTION

Briefly described, the present invention comprises a valve component for a hydraulic actuator of the type including a cylinder component, a piston component that reciprocates within the cylinder component and a valve having a valve seat for controlling the flow of hydraulic oil through the valve seat. The valve component forms part of the valve and is displaceable from the valve seat. The valve is in fluid communication with one of the working chambers of the piston/cylinder components. The piston component reciprocates within the cylinder component in a manner well known in the art. The valve component has a valve stem that extends through the sidewall of the cylinder component and into the path of travel of the piston component. The valve component also includes a fulcrum point about which the valve component pivots to unseat the valve component as the piston component engages the valve stem.

Preferably, the valve stem extends substantially perpendicular to the path of travel of the piston component. The valve seat is laterally positioned from the path of travel of the piston component, so that displacement of the valve stem causes the valve component to pivot and unseat the valve component.

Preferably, the valve includes a spring to bias the valve component into a seated position. It is also preferred to provide a second spring to bias the valve component against pivotal movement caused by the engagement of the piston component and the valve stem.

In a preferred embodiment, the valve component includes a base member having an outer peripheral edge that forms the fulcrum point of the valve component. The base member includes openings through which hydraulic oil can flow when the valve component is displaced.

In a preferred application, the valve is used in combination with a linear hydraulic motor, wherein the piston component of the motor includes a double shoulder element forming an outer shoulder and an inner shoulder longitudinally staggered from the outer shoulder. The outer shoulder is adapted to engage the valve stem and cause the valve component to pivot and unseat from the valve seat. The inner shoulder is adapted to engage the end wall of the cylinder component and stop the piston component.

With the present invention, the valve can be repositioned from the cylinder end wall to the cylinder sidewall and still function to act as a check valve upon the piston component reaching the end of its stroke and engaging the valve component of the check valve. Accordingly, for applications wherein the design of the cylinder end wall does not allow for the inclusion of a check valve, or other type of valve, the present invention provides a solution that is relatively simple in design and which reliably functions to control the flow of fluid in a manner similar to prior art hydraulic systems.

These and other advantages, objects and features of the present invention will become apparent from the following detailed description of the best mode, and the accompanying drawings, and the claims, all of which are incorporated herein as a disclosure of the invention.

BRIEF DESCRIPTION OF THE DRAWINGS

Like reference numerals refer to like parts throughout the several views, wherein.

BEST MODE FOR CARRYING OUT THE INVENTION

Figure 2:
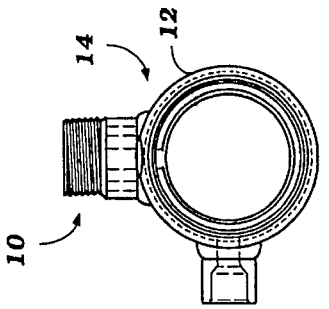
FIG. 2 is an end elevation view of the cylinder component and check valve of FIG. 1.
Figure 1:
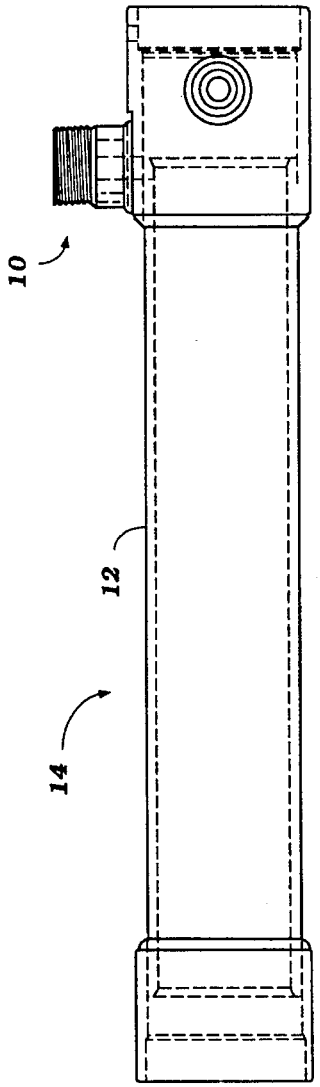
FIG. 1 is a side elevation view of a cylinder component of a linear hydraulic motor with the check valve of the present invention installed thereon; the check valve is shown without its cap portion.
Figure 3:
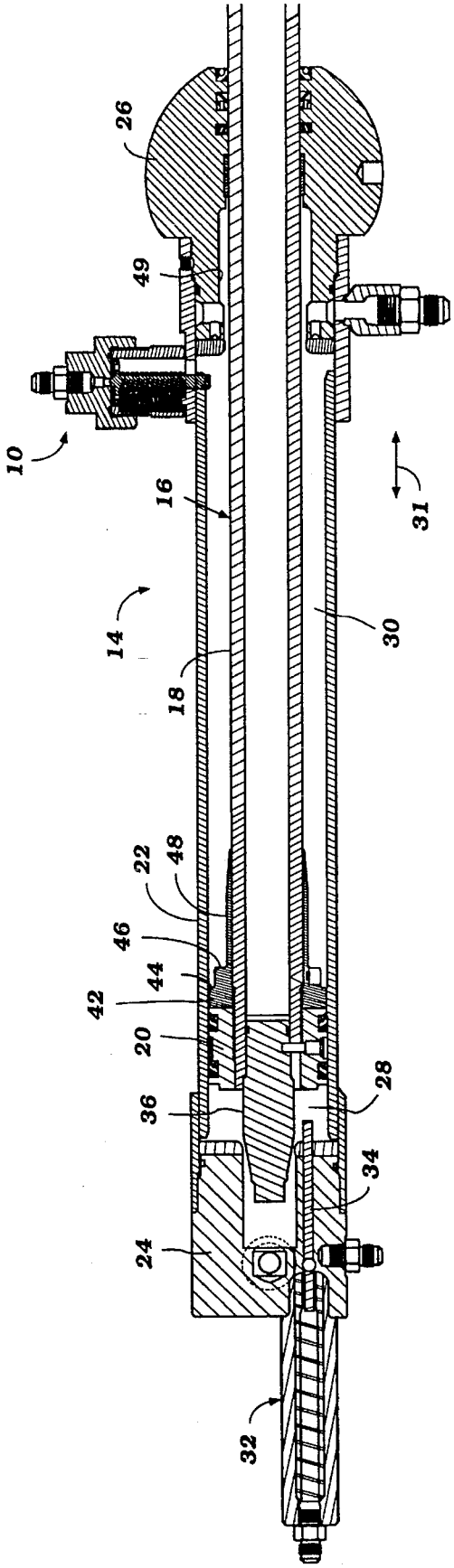
FIG. 3 is a longitudinal sectional view of the linear hydraulic motor and check valve of the present invention.

Referring now to FIGS. 1–3, the hydraulic check valve 10 of the present invention is shown mounted laterally at one end of a cylinder component 12 of a hydraulic actuator 14. Check valve 10 is shown in FIGS. 1 and 2 with its cap piece removed. The cap piece is shown in FIG. 3 and discussed in more detail with reference to FIG. 4. Hydraulic actuator 14 includes a piston component 16, which includes a hollow piston rod 18 and a piston head 20, shown in FIG. 3. Cylinder component 12 includes a tubular cylinder wall 22, a first end wall 24 and a second end wall 26 in the form of a ball member adapted to pivotally fit into a socket (not shown) for universal movement of the actuator relative to the socket. Threaded connections join cylinder wall 22 with end walls 24, 26.

Piston component 16 divides cylinder component 12 into a first working chamber 28 and a second working chamber 30. Hydraulic actuator 14 is discussed in more detail in my co-pending application Ser. No. 08/560,799, entitled, "Bulk Material Handling System". The term "laterally" is used to mean a direction substantially perpendicular to the longitudinal movement of piston component 16 indicated by arrow 31.

A first check valve 32 is mounted in first end wall 24 of cylinder component 12. Check valve 32 is relatively conventional in design and is mounted in end wall 24 in a manner well known in the art. Check valve 32 includes a displaceable valve actuator 34, the leading end of which extends into first working chamber 28 of actuator 14. In operation, piston component 16 engages valve actuator 34 when piston component 16 reaches the end of its stroke near end wall 24. Valve actuator 34 is displaced longitudinally, which ports fluid through check valve 32 for the purpose of switching a directional control valve to redirect hydraulic pressure from second working chamber 30 into first working chamber 28.

Piston component 16 includes a snubber element 36, which functions as an end-of-stroke cushion to prevent piston component 16 from slamming into end wall 24. Snubber element 36 and check valve 32 form no part of the present invention and are illustrated merely to show conventional elements typically included in hydraulic actuators. For purposes of the present invention, it is only necessary that hydraulic actuator 14 include cylinder component 12 and piston component 16.

Piston component 16 also includes an annular double shoulder collar 42. Double shoulder collar 42 and piston head 20 are threadably mounted onto piston rod 18 and include necessary seals for sealing between first working chamber 28 and second working chamber 30. Double shoulder collar 42 includes an outer shoulder 44 and an inner shoulder 46, with shoulders 44, 46 staggered longitudinally from each other. Double shoulder collar 42 also includes a forward smaller diameter sleeve 48, which functions as a snubber when piston component 16 reaches the other end of its stroke adjacent valve 10 and forward sleeve 48 moves into recess 49 formed in ball end 26.

Figure 4:
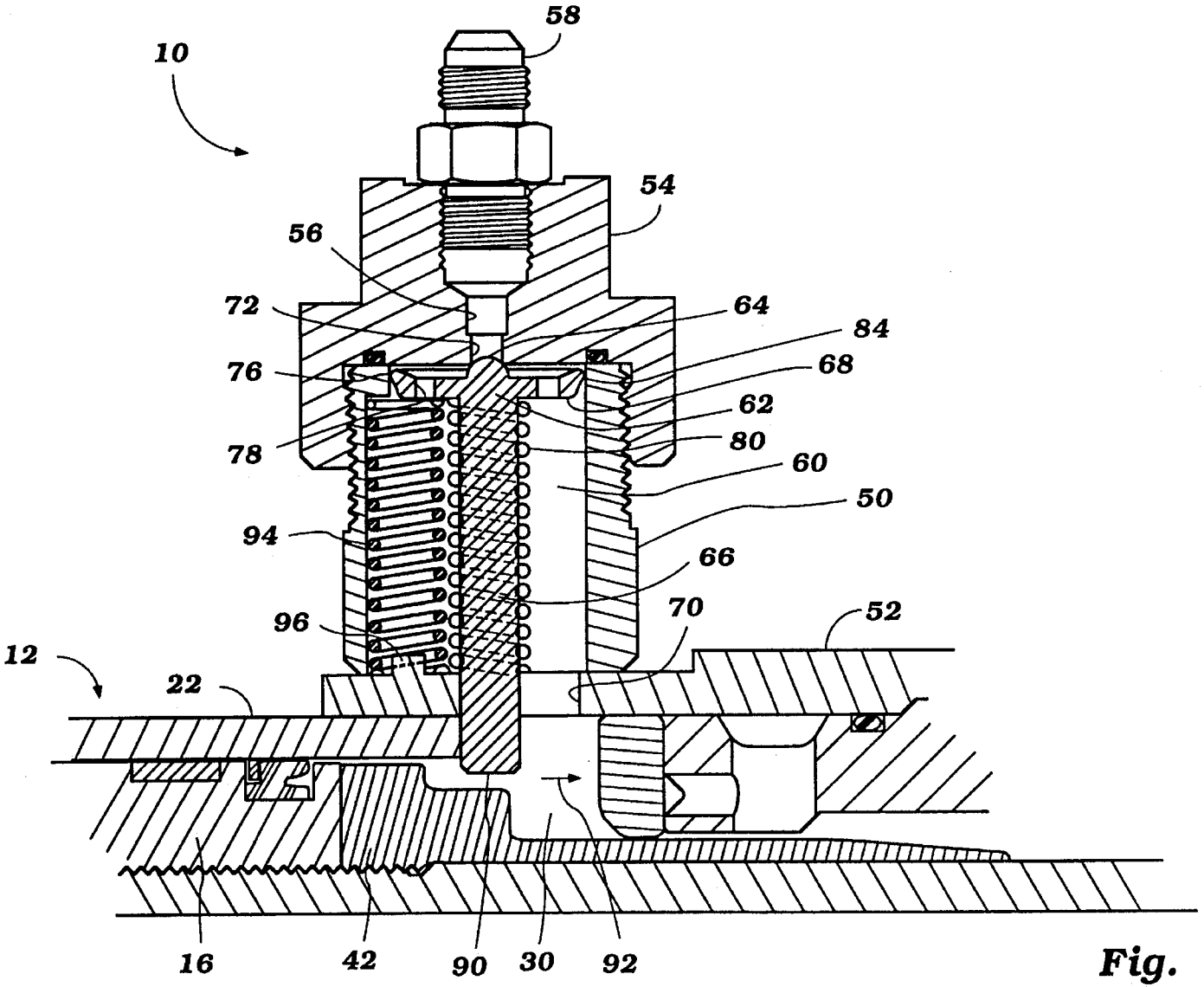
FIG. 4 is an enlarged detail sectional view of the check valve of the present invention with a portion of the linear hydraulic motor being illustrated.
Figure 5:
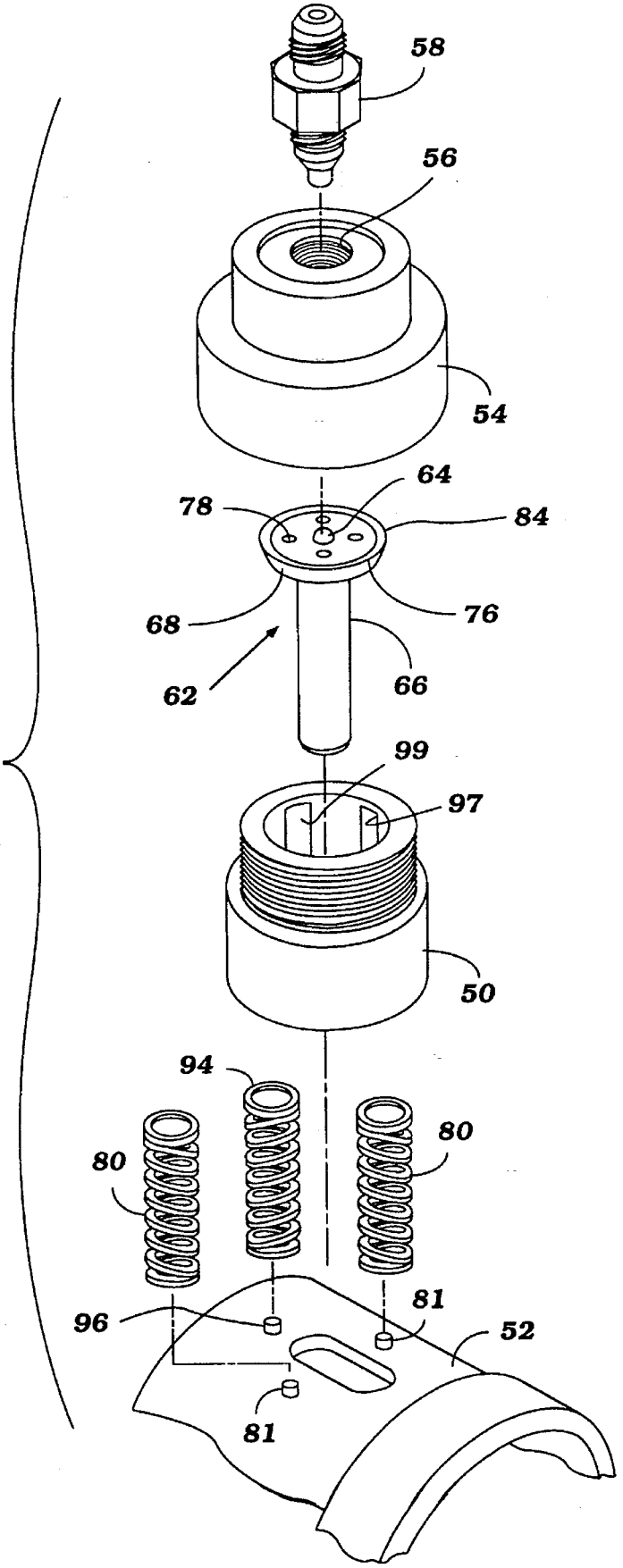
FIG. 5 is an exploded pictorial view of the check valve of FIG. 4.

As best shown in FIGS. 4 and 5, valve 10 includes a main cylindrical body sidewall 50 that is exteriorly threaded along its outer portion. Sidewall 50 is welded to a tubular sleeve 52, which, in turn, is welded to tubular wall 22 of cylinder component 12. An internally-threaded valve cap 54 threads onto sidewall 50. Valve cap 54 includes a central port 56, which leads to a fitting 58 threadably secured to cap 54. Fitting 58 provides a connection point for a hydraulic line (not shown).

Cap 54, sidewall 50, and sleeve 52 define an inner valve chamber 60 in which a valve component 62 is positioned. Valve component 62 includes a valve plug 64, a valve stem 66, and a collar-like base portion or base member 68. Sleeve 52 includes a slot opening 70, one end of which is aligned with the end of tubular wall 22. Valve stem 66 extends through slot 70 into second working chamber 30 of cylinder component 12 and into the path of travel of piston head 16 and collar 42. A valve orifice 72 is formed at the junction of port 56 and inner chamber 60. Valve plug 64 seats against the inner end wall of cap 54 to close off valve orifice 72 and prevent fluid communication between port 56 and valve chamber 60.

Referring to FIG. 5, the base member 68 of valve component 62 includes a flared rim 76 and openings 78 radially spaced from stem 66. Openings 78 allow fluid to pass from one side of base member 68 to the other and, thus, from inner chamber 60 to port 56. Two coil springs 80 are positioned in valve chamber 60 on opposite sides of valve stem 66 and function to bias valve component 62 into a seated, closed position. The bottom ends of coil springs 80 are biased against sleeve 52 and held in position by small nubs 81. The top ends of springs 80 are biased against base member 68.

Base member 68 provides a fulcrum point 84 at its flared rim 76 about which valve member 62 can pivot when the double shoulder collar 42 of piston component 16 engages the distal end 90 of valve stem 66 and displaces distal end 90 in the direction shown by arrow 92 (FIG. 4). As will be discussed in more detail with reference to FIG. 9, valve stem 66 acts as a lever when engaged by piston component 16, causing valve component 62 to unseat as it pivots about fulcrum point 84.

A third coil spring 94 is provided to one side of valve stem 66 and within inner chamber 60 to bias valve component 62 against pivotal movement about fulcrum point 84 caused by displacement of the distal end 90 of valve stem 66. A small nub 96 is formed on the exterior surface of sleeve 52 to anchor one end of spring 94. Nub 96 prevents spring 94 from migrating circularly around valve stem 66.

Figure 6:
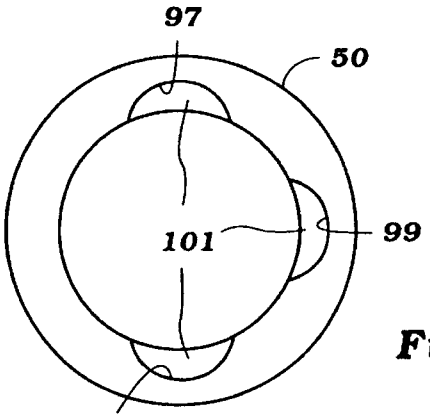
FIG. 6 is a top view of the main cylindrical body portion of the check valve of FIGS. 4 and 5, showing the scalloped channels along the interior sidewall of the cylinder.
Figure 7:
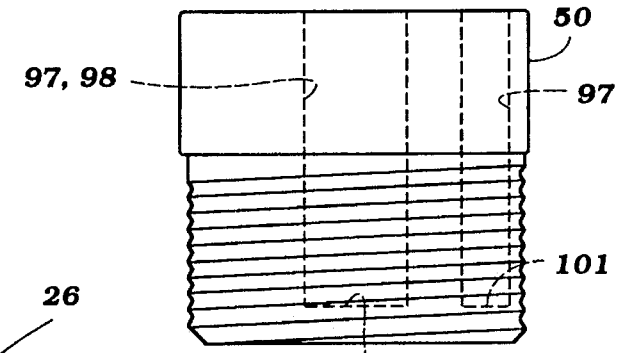
FIG. 7 is a side elevation view of the cylindrical body of FIG. 6, showing the scalloped channels in dashed lines.

Referring to FIGS. 6 and 7, the main cylindrical body portion 50 of the check valve includes three scalloped channels 97, 98, 99. Channels 97, 98, 99 extend from the lower unthreaded end of cylinder 50 and terminate adjacent the upper threaded end of cylinder 50. This forms a shoulder 101 at the upper threaded end. The outer coil portions of springs 80, 94 are positioned in channels 97, 98, 99 and the top ends of springs 80, 94 partially abut shoulders 101. Channels 97, 98, 99, in conjunction with nubs 81, 96, function to keep springs 80, 94 aligned within valve chamber 60.

Figure 8:
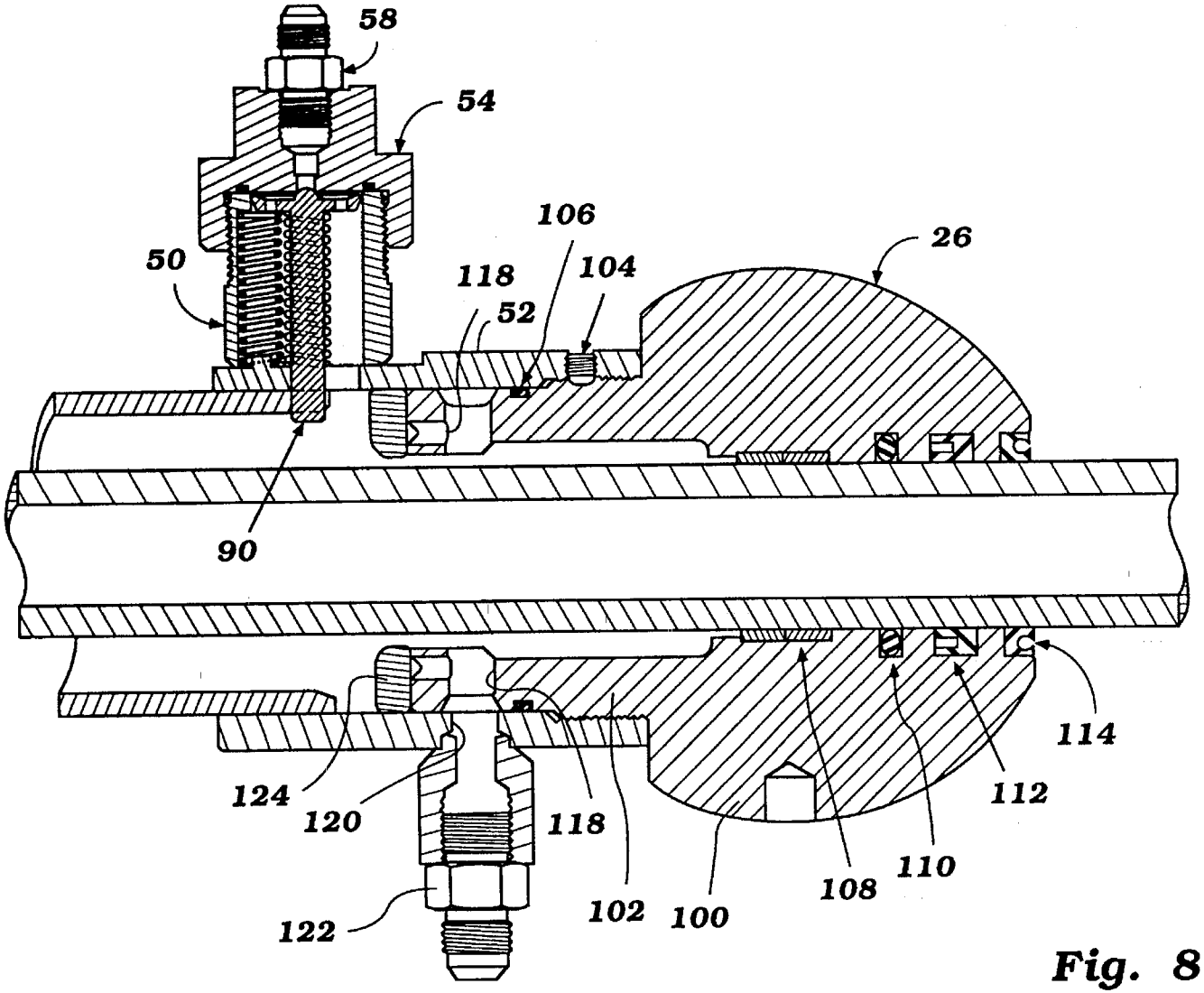
FIG. 8 is a sectional view of the check valve of FIGS. 4 and 5 and the ball end portion of the cylinder component.

Referring to FIG. 8, ball end 26 of cylinder component 12 includes a ball portion 100 and an annular collar 102. Collar 102 is externally threaded for threaded engagement with the interiorly-threaded outer end of sleeve 52. A set screw 104 anchors ball end 26 to sleeve 52. Appropriate seals 106, 108, 110, 112, 114 are provided to seal working chamber 30 from atmosphere. Collar 102 also includes an annular port channel 118 and sleeve 52 includes an opening 120, which provide a passageway to fitting 1.22 for connection to a hydraulic line (not shown). An annular cushion washer 124 butts against collar 102 to cushion engagement of the piston head with ball end 26.

Figure 9:
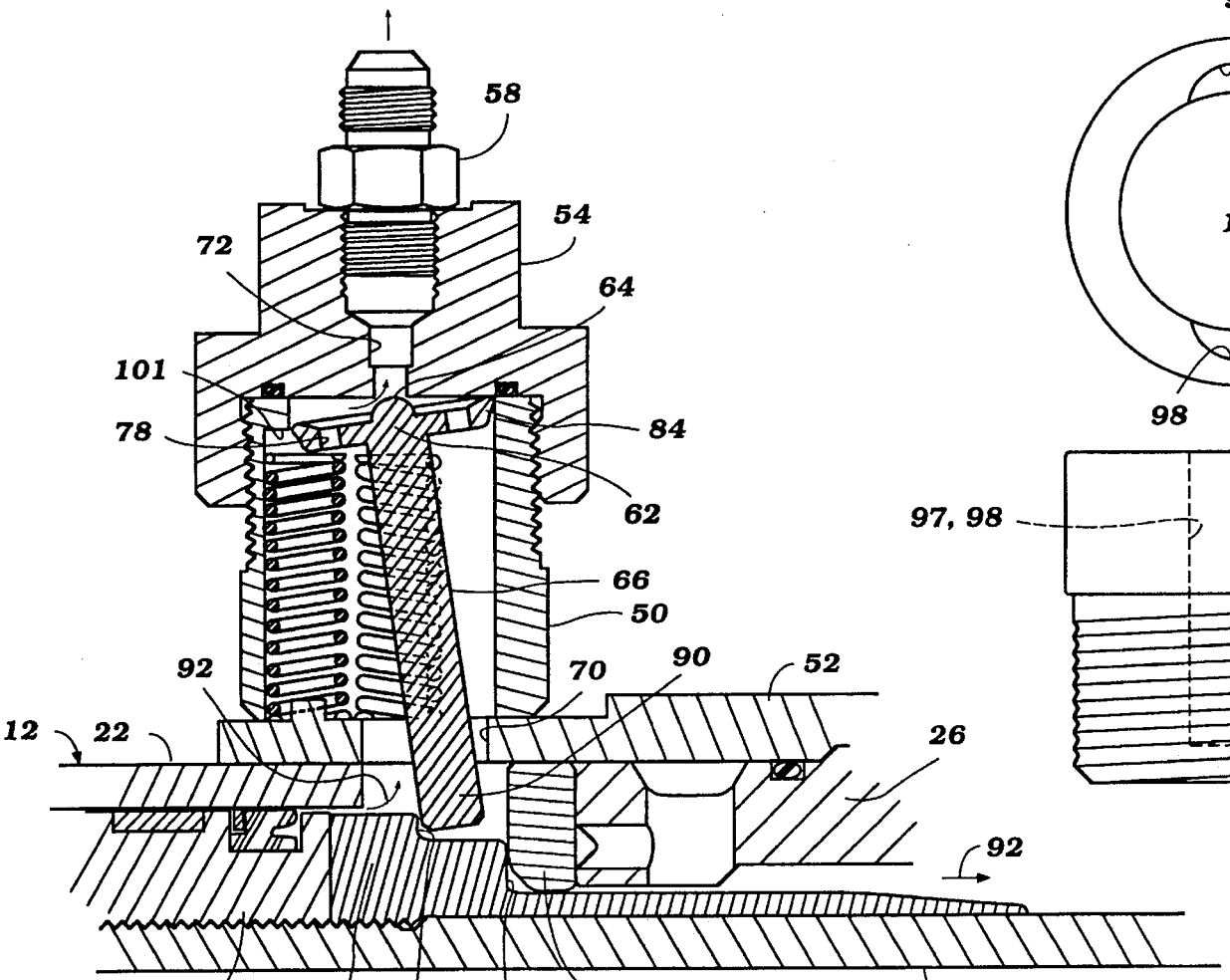
FIG. 9 is a view like FIG. 4 showing the valve component displaced by the piston component of the linear hydraulic motor.

As shown in FIG. 9, when piston component 16 reaches the end of its stroke adjacent ball end 26, outer shoulder 44 of double shoulder collar 42 engages distal end 90 of valve component 62 and causes valve component 62 to pivot about fulcrum point 84. Valve stem 66 pivots within slot 70, in the direction indicated by arrow 92, until inner shoulder 46 of double shoulder 42 engages cushion washer 124. When valve component 62 is in the position shown in FIG. 9, valve plug 64 unseats, or opens, allowing hydraulic fluid to move through openings 78 into orifice 72 and port through fitting 58 to a hydraulic line (not shown), in the direction indicated by arrow 130.

Contact between inner shoulder 46 and cushion 124 stops movement of piston component 16. Note that the longitudinal spacing between the outer shoulder and the inner shoulder is less than the distance between valve stem 66 and cylinder end wall 26, that is, between the left side of valve stem 66 (as shown in FIG. 9) and cushion 124. This space relationship ensures that collar 42 bottoms out against cushion 124 without valve stem 66 engaging the end of slot 70.

Spring 94 functions to bias valve component 62 against pivotal movement in the direction shown in FIG. 9. Spring 94 is anchored at its lower inner end by nub 96 and its opposite end pushes against base portion 68 of valve component 62 and shoulder 101. Thus, when piston component 16 reverses direction and outer shoulder 44 moves to the left, spring 94 returns valve component 62 to its original position with valve plug 64 seated into orifice 72.

While the foregoing description has been that of a check valve for a hydraulic actuator, the present invention is not intended to be limited to a check valve or a hydraulic actuator. The particular pivotally-displaced valve component described herein can be used in a variety of valves that perform functions in addition to or different from that of a check valve. Likewise, the present invention could also be utilized in a pneumatic actuator and, therefore, is not intended to be limited to hydraulic systems.

The valve stem 66 is claimed as having a side portion positioned to be engaged by an activator moving substantially perpendicularly to the stem to pivot the valve component about its pivot point. The side portion referenced in the claim refers to the lower point on valve stem 66 that is engaged by outer shoulder 44 of collar 42. However, the hydraulic valve of the present invention can be utilized in applications other than a linear hydraulic motor. In other applications, the component that engages the side portion of the valve stem may not be a collar or a piston head, but could be, for example, the valve spool of a directional valve. Thus, the term "activator" is used to mean any movable component of a device to which the valve is mounted. In other applications, it is merely necessary for the activator to be moving substantially perpendicular to the valve stem, so as to cause the valve stem to pivot.

The base portion 68 of valve component 62 is defined, in some claims, as an extension projecting outwardly from valve stem 66. The pivot point of the valve component is defined as this extension from the valve stem. The base member does not necessarily have to be circular or necessarily extend around the circumference of the valve plug, but could comprise first and second outer portions that extend radially in opposite directions from the valve plug. In this manner, the pivot point would be defined at the end of one of the outer portion extensions. The pivot point, in this alternative design, would still rest in the corner defined by the main cylinder sidewall and the end wall of the valve cap.

It is to be understood that many variations in size, shape, and construction can be made to the illustrated and above-described embodiment without departing from the spirit and scope of the present invention. Some of the features of the preferred embodiment may be utilized without other features. Therefore, it is to be understood that the presently described and illustrated embodiment is non-limitive and is for illustration only. Instead, my patent is to be limited for this invention only by the following claim or claims interpreted according to accepted doctrines of claim interpretation, including the doctrine of equivalents and reversal of parts.

What is claimed is:

1. In a hydraulic actuator of the type including a cylinder component, a piston component that reciprocates within the cylinder component and defines first and second working chambers within the cylinder component, the first and second working chambers adapted to receive hydraulic pressure so that the pressure can act on the piston component, a valve having a valve seat and a displaceable valve component for controlling flow of hydraulic oil through the valve seat, the valve being in fluid communication with one of said first and second working chambers, so that displacement of the valve component ports pressure from the working chamber in communication therewith, the improvement therein comprising:

the valve component having a valve stem that extends through a side wall of the cylinder component and into the path of travel of the piston component and a fulcrum point about which the valve component can pivot so as to unseat the valve component as the piston component engages the valve stem.

2. The hydraulic actuator of claim 1, wherein the valve stem extends substantially perpendicular to the path of travel of the piston component.

3. The hydraulic actuator of claim 2, wherein the valve seat is laterally positioned from the path of travel of the piston component.

4. The hydraulic actuator of claim 3, wherein the valve includes a spring to bias the valve component into a seated position.

5. The hydraulic actuator of claim 4, wherein the valve includes a second spring adapted to bias the valve component against pivotal movement caused by the engagement of the piston component with the valve stem.

6. The hydraulic actuator of claim 4, wherein the valve component includes a base member, the outer peripheral edge of which forms the fulcrum point of the valve component, the base member including openings through which hydraulic oil can flow.

7. The hydraulic actuator of claim 6, wherein the outer peripheral edge of the base member includes a flared rim.

8. The hydraulic actuator of claim 1, wherein the piston component includes a double shoulder element forming an outer shoulder and an inner shoulder, the outer shoulder adapted to engage the valve stem and cause the valve component to pivot and unseat from the valve seat, the inner shoulder adapted to engage an end wall of the cylinder component and stop the piston component.

9. The hydraulic actuator of claim 8, wherein the longitudinal spacing between the outer shoulder and the inner shoulder is less than the distance between the valve stem and the cylinder end wall.

10. The hydraulic actuator of claim 1, wherein the cylinder component includes an end wall in the form of a ball adapted to fit into a socket to provide a universal joint between the actuator and another structure, the valve being positioned adjacent the ball.

11. In a hydraulic actuator of the type including a cylinder component, a piston component that reciprocates within the cylinder component and defines first and second working chambers within the cylinder component, the first and second working chambers adapted to receive hydraulic pressure so that the pressure can act on the piston component, a valve having a valve seat and a displaceable valve component for controlling flow of hydraulic oil through the valve seat, the valve being in fluid communication with one of the first and second working chambers, so that displacement of the valve component ports pressure from the working chamber in communication therewith, the improvement therein comprising:

the valve component having a valve stem that extends into the path of travel of the piston component, the valve component adapted to pivot or rotate and unseat itself when the piston component engages and displaces the valve stem.

12. In a hydraulic actuator of the type including a cylinder component, a piston component that reciprocates within the cylinder component and defines first and second working chambers within the cylinder component, the first and second working chambers adapted to receive hydraulic pressure so that the pressure can act on the piston component, a valve having a valve seat and a displaceable valve component for controlling flow of hydraulic oil through the valve seat, the valve being in fluid communication with one of said first and second working chambers, so that displacement of the valve component ports pressure from the working chamber in communication therewith, the improvement therein comprising:

the valve component being pivotally mounted within the valve so that pivotal movement of the valve component seats and unseats the valve component, the valve component extending into the path of travel of the piston component so that when the piston component engages the valve component, the valve component pivots.

13. A valve comprising:

an end wall that partially defines a valve chamber, the end wall including an orifice extending therethrough;

a valve component in the valve chamber including a valve plug, a base portion extending radially from the plug, and a valve stem projecting axially from the plug; the plug having a closed position in which the plug closes the orifice and an open position in which the plug is displaced from the orifice; the valve component including a pivot point about which the valve component can pivot to open and close the valve plug;

the stem having a side portion positioned to be engaged by an activator moving substantially perpendicularly to the stem to pivot the valve component about its pivot point, and further comprising a first spring positioned to bias the valve plug toward its closed position and toward the orifice to close the orifice, and a second spring positioned to engage the base portion on a side of the stem opposite the pivot point to bias the valve component against pivotal movement.

14. The valve of claim 13, wherein the pivot point of the valve component is defined by an extension projecting outwardly from the valve stem.

15. The valve of claim 14, wherein the extension comprises a base member adjacent the valve plug.

16. The valve of claim 15, wherein the base member includes first and second outer portions extending radially in opposite directions.

17. The valve of claim 16, wherein the valve chamber is further defined by a side wall and the side wall and end wall form a corner wherein is positioned the distal end of one of the first and second portions of the base member.

18. The valve of claim 13, and further comprising a spring to bias the valve component in either a closed position or an open position.

19. The valve of claim 13 in combination with a linear motor, the linear motor including a cylinder component and a piston component movable within the cylinder component, the cylinder component and piston component defining first and second working chambers within the cylinder component, the first and second working chambers adapted to receive hydraulic pressure so that the pressure can act on the piston component, the activator adapted to move in conjunction with the piston component, the valve being in fluid communication with one of the first and second working chambers so that displacement of the valve component ports pressure from the working chamber in communication therewith.

20. The valve of claim 19, wherein the valve stem extends through an opening in the cylinder component adjacent an end of the cylinder component.

21. In a hydraulic actuator of the type including a cylinder component, a piston component that reciprocates within the cylinder component and defines first and second working chambers within the cylinder component, the first and second working chambers being adapted alternatively connectable to a source of hydraulic pressure so that the pressure can act on the components to cause relative axial reciprocating movement between the piston component and the cylinder component, and a valve having a valve seat and a displaceable valve component for controlling flow of hydraulic pressure through the valve seat, the valve being in fluid communication with the first working chamber so that displacement of the valve component ports pressure from the first working chamber, the improvement therein comprising:

the valve component having a valve stem that extends radially through a sidewall of the cylinder component and into the first working chamber and a fulcrum point about which the valve component can pivot so as to unseat the valve component, the valve component being biased to remain seated until the valve stem is engaged and moved by the piston component.

* * * * *